US005163413A

United States Patent [19]

Carella

[11] Patent Number: 5,163,413

[45] Date of Patent: * Nov. 17, 1992

[54] ARCHERY TRAINING DEVICE

[76] Inventor: Richard F. Carella, 35572 Strathcona Dr., Mt. Clemens, Mich. 48043

[ * ] Notice: The portion of the term of this patent subsequent to Oct. 1, 2008 has been disclaimed.

[21] Appl. No.: 639,190

[22] Filed: Jan. 9, 1991

Related U.S. Application Data

[63] Continuation-in-part of Ser. No. 432,794, Nov. 6, 1989, Pat. No. 5,052,365, which is a continuation-in-part of Ser. No. 58,395, Jun. 5, 1987, Pat. No. 4,909,232, and a continuation-in-part of Ser. No. 934,674, Nov. 25, 1986, Pat. No. 4,887,584, and a continuation-in-part of Ser. No. 891,863, Jul. 30, 1986, abandoned, and a continuation-in-part of Ser. No. 848,983, Apr. 7, 1986, abandoned.

[51] Int. Cl.[5] ..... F41B 5/00; A63B 21/02

[52] U.S. Cl. ..... 124/90; 124/88; 482/122

[58] Field of Search ..... 124/86, 88, 90, 80, 124/35.2, 20.1, 20.3, 17, 23.1, 22; 272/137, 135, 141-143, 67, 68; 434/247, 258

[56] References Cited

U.S. PATENT DOCUMENTS

| | | | |
|---|---|---|---|
| 3,108,583 | 10/1963 | Andis | 124/90 X |
| 3,462,142 | 8/1969 | Sterndale | 272/143 X |
| 4,026,549 | 5/1977 | Gunn | 272/137 |
| 4,079,933 | 3/1978 | Everroad | 272/126 X |
| 4,245,840 | 1/1981 | Van Housen | 272/137 |
| 4,279,601 | 7/1981 | Cobelli | 272/137 X |
| 4,609,191 | 9/1986 | Remme | 272/137 |
| 4,854,293 | 8/1989 | Roberts | 124/35.2 |
| 4,860,720 | 8/1989 | Todd | 124/35.2 |
| 4,909,232 | 3/1990 | Carella | 124/86 X |
| 4,961,264 | 10/1990 | Topel | 124/90 X |
| 5,052,365 | 10/1991 | Carella | 124/90 |

*Primary Examiner*—Peter M. Cuomo
*Attorney, Agent, or Firm*—Remy J. VanOphem

[57] ABSTRACT

An archery training device for teaching an archer proper upper body muscular control and positioning whiel shooting a bow. The archery training device includes a string arm connector having an upper loop that is securable to the archer's string arm above the elbow. A lower loop is securable to the string arm below the elbow. The loops cooperate upon pulling the string arm connector in relation to the bowstring to prevent shifting of the string arm connector with respect to the elbow of the string arm. An elastomeric force carrying member extends between the bowstring and the string arm connector and is secured to the bowstring with a rope segment securely attached to the elastomeric force carrying member. The elastomeric force carrying member is extendable between a relaxed configuration prior to bowstring release and a stretched configuration after bowstring release. The muscles associated with the archer's upper body function upon and after release of the bowstring to restrain the bow hand, string arm, and shoulders from movement that would adversely affect shooting accuracy.

13 Claims, 4 Drawing Sheets

ARCHERY TRAINING DEVICE

CROSS REFERENCE TO RELATED APPLICATIONS

This is a continuation-in-part patent application of co-pending U.S. patent application Ser. No. 432,794 filed Nov. 6, 1989, now U.S. Pat. No. 5,052,365 which is a continuation-in-part application of U.S. patent application Ser. No. 058,395 filed Jun. 5, 1987, now issued U.S. Pat. No. 4,909,232, and U.S. patent application Ser. No. 934,674 filed Nov. 25, 1986, now issued U.S. Pat. No. 4,887,584, U.S. patent application Ser. No. 891,863 filed Jul. 30, 1986, now abandoned, and U.S. patent application Ser. No. 848,983, filed Apr. 7, 1986, now abandoned.

BACKGROUND OF THE INVENTION

1. Field of the Invention

This invention relates to an archery training device for teaching an archer proper muscular, control and body positioning before, during, and after string release for accurate shooting of a bow with or without an arrow.

2. Description of the Prior Art

An observer of an archer shooting a bow and arrow occasionally witnesses a flinching or collapsing of the archer's upper body muscles while the string fingers are in the process of releasing the bowstring. Such body movement results in inconsistent and inaccurate shooting. Its cause is attributable to the archer having relaxed upper back muscles so that the bow hand, string arm, or shoulders begin to move before the string fingers are free of the bowstring.

The period during which the upper back muscles relax before the fingers are completely free of the bowstring has been termed "reflex muscle relax time." This period begins when the string fingers start to open and ends when they are completely free of the forward pull exerted by the bowstring.

"Target panic" is another term used to describe what happens during the reflex muscle relax time. It denotes the involuntary response exhibited by the archer's upper body back muscles to relax during the string fingers' release. "Target panic" develops in all seasoned archers and is attributable to sound and sight. Often, the archer will begin to release the bowstring before the arrow is correctly aimed by sight, or he will anticipate the sound of a draw clicker and relax his upper back muscles prematurely.

In general, the shorter the "reflex muscle relax time", the less opportunity there will be for adverse movement of the archer's bow hand, string arm, and shoulders. Consequently, he or she will shoot more consistently and accurately. Additionally, proper muscular control and positioning of the bow hand, string arm, and shoulders during the "reflex muscle relax time" will also reduce previously noted flinching and collapsing of the archer's upper body associated with the "reflex muscle relax time", and thus promote consistent and accurate shooting.

The importance of an archer practicing every day to improve his skills and body muscles associated with these skills has led to a need for training devices that can be used safely without injury to the archer or persons nearby. It would be desirable to provide a device which can be used without an arrow, thereby enabling practice of the archer's muscles used in shooting a bow to occur without need for an archery range and without damaging equipment or injuring bystanders. Additionally, it would be useful if such a device could be used indoors, between shots at a tournament, or while hunting in order to keep muscles correctly stretched and toned.

Archery training devices are well known in the art. For example, in U.S. Pat. No. 4,887,584, there is disclosed a training device for teaching an archer proper body positioning in a draw stance upon string release for shooting of an arrow. A bow handle of either a contoured or strap construction for providing a draw force by isometrics is connected to the anchor point by an elastic spring to provide a simulated draw force such that as the archer pushes against the bow handle with the bow arm and pulls with the string arm until the anchor point is properly located, the archer's body is properly loaded with the actual bow draw force, isometric force, or spring force that simulates the bow draw force. Loading of the archer's body on the plane of release through "muscle memory" trains the archer to duplicate the proper position during actual shooting.

In U.S. Pat. No. 4,279,601 there is disclosed an archery training and exercise device which includes a gripping handle, an elastic cord connected to the gripping handle, and a sighting rod extending from the gripping handle to permit a student archer to learn proper bow hand position and sighting while strengthening the particular muscles required for archery without the necessity for using an actual bow. The device is not intended to be used with an actual bow used by the archer. Mosher, U.S. Pat. No. 4,591,150, discloses an exercise device consisting of two telescoping longitudinal members that are interconnected by an elastic cable. The device has an auxiliary cross member affixed on the tubular longitudinal member near the open end of it where the other longitudinal member enters it. The auxiliary cross member permits an increased repertoire of exercise to be performed with the device, including archery pulls.

Remme, U.S. Pat. No. 4,609,191, discloses an archery exercise device for use by archers as a practice aid and a means for strengthening the muscle groups used for drawing and holding the draw of a bow and as a warm up device preparatory for practice or shooting. This device is not intended to be used with the actual bow used by the archer.

Accordingly, what is needed is an archery training device which aids in reducing the effects of the "reflex muscle relax time" by promoting proper positioning of the bow hand, string arm, and shoulders of the archer when he or she is drawing and releasing the actual bowstring of a bow intended to be used by the archer. In addition, what is needed is such an archery training device that will also promote proper muscular exercise for control of the archer's upper back muscles, bow hand, string arm and shoulders throughout the drawing and releasing sequence of actually shooting a bow with or without an arrow.

SUMMARY OF THE INVENTION

The invention is an archery training device for teaching an archer proper upper body muscular control and positioning while shooting a bow with or without an arrow. The device includes a string arm connector which has a pair of loops, one being an upper loop securable to the upper arm of the archer's string arm proximate the elbow, and the other being a lower loop which is securable to the forearm of the archer's string arm proximate the elbow. Together, the loops cooperate by straddling the string arm elbow to prevent shifting of the string arm connector about the elbow. An elastomeric force carrying member is connected to the string arm connector and extends towards the bowstring and is secured to the bowstring. The elastomeric force carrying member is in a relaxed configuration during the time the bowstring is drawn by an archer and, therefore, at its shortest distance from the archer's string arm elbow. Upon the string fingers' release of the bowstring, the elastomeric force carrying member extends from the string arm connector in a direction towards the bow as the bowstring advances towards the bow, resulting in the elastomeric force carrying member being in a stretched or fully extended configuration. In either configuration, the elastomeric force carrying member will be adjacent the archer's neck if the archer has his bow hand, string arm and shoulders correctly positioned as explained hereinafter.

The archery training device provides the archer feedback about his upper body position and reflex muscle relax time after the bowstring is released. The feedback is based on an imbalance of forces exerted by upper back muscles which cause adverse movement of the bow hand, string arm, and shoulders or an incorrect positioning of the bow hand, string arm and shoulders whereby the elastomeric force carrying member moves away from the side of the neck, thus adversely affecting shooting accuracy.

I have discovered that there are three keys to consistent and accurate shooting. The first key is to position the archer's bow hand, string arm, and shoulders so that they are coplanar. In a full draw position, points representing each of these body parts ideally should be located on a single plane which I have termed a "rigid frame plane." An archer properly maintaining the rigid frame plane during the reflex muscle relax time will reduce movement of the bow hand, string arm, and shoulders in a manner which will improve shooting accuracy.

The second key is to keep the correct upper back muscle forces working upon and after release of the bowstring by the string fingers and thereby minimize the adverse effects associated with the reflex muscle relax time. The third key is to push with the front upper body half and pull with the rear upper body half in order to attain correct muscle force expansion balance. Note, each half works independent of the other half. After the bow is fully drawn and correctly aimed, the archer releases the bowstring. As the bowstring travels towards the bow, the elastomeric force carrying member extends between its relaxed configuration and its stretched configuration. When extended, the elastomeric force carrying member produces a tensile force between the bowstring and string arm elbow which is consequently transmitted to the muscles of the string arm, the shoulder, the back, the bow arm, the bow hand and most of the upper body framework. Thus, the tensile force is effectively transmitted between the bow hand and string arm and, therefore, requires the upper back muscles to continue to push and pull throughout the shot, thus training the upper back muscles by repeated exercise to shorten reflex muscle relax time by inhibiting collapse of the upper back muscles, shoulders and string arm.

According to a preferred aspect of this invention, by repeated use of the archery training device, the archer's rear upper back develops a "muscle memory" of the shortened reflex muscle relax time which enables him to shoot this shortened reflex without the training device. Continuous feedback by the elastomeric force carrying member within the rigid frame plane develops muscle memory allowing for duplication of this correct position without the training device during actual shooting.

In addition, a significant advantage of the present invention is that the tensile force exerted by the elastomeric force carrying member counteracts the bow force during release. This tensile force substitutes for the weight of the arrow and prevents the bow from being damaged.

Accordingly, it is an object of the present invention to provide an archery training device which is capable of promoting proper positioning of an archer's bow hand, string arm and shoulders so that they are coplanar.

It is a further object of this invention that such an archery training device be capable of promoting proper muscular control in the archer's upper back throughout the drawing and releasing of the bowstring.

It is still a further object of this invention that such an archery training device provide feedback to the archer, promoting reduced movement of the archer's bow hand, string arm and shoulders during the release of the bowstring.

It is yet another object of this invention that such an archery training device with repeated use will develop "muscle memory" in the archer such that the archer will duplicate proper posture and muscular control when not using the training device during actual shooting.

Other objects and advantages of this invention will be more apparent after a reading of the following detailed description taken in conjunction with the drawings provided.

DETAILED DESCRIPTION OF THE PREFERRED EMBODIMENT

Figure 1:
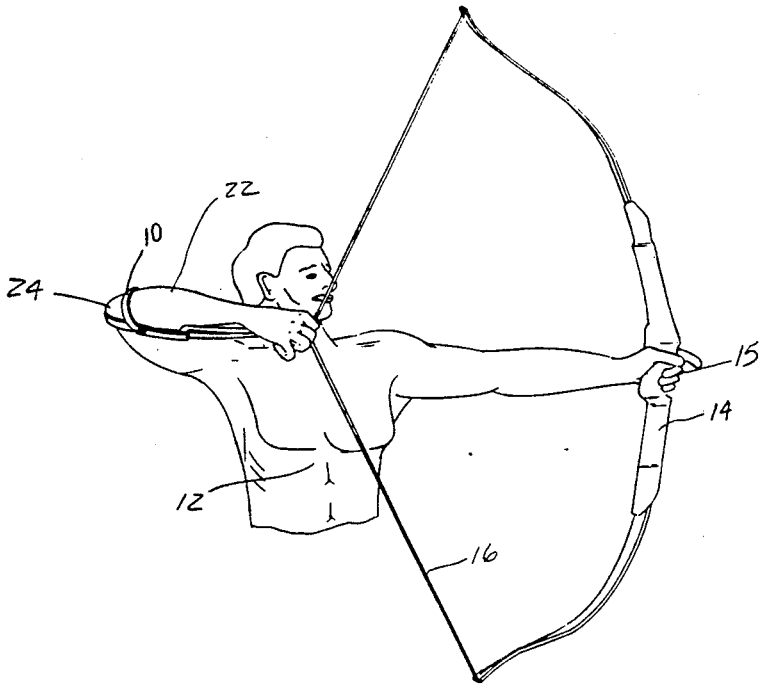
FIG. 1 is a prespective view of an archer using an archery training device that is used with an archery bow, the archery bow being shown in a full draw configuration.

A preferred embodiment of an archery training device constructed in accordance with the present invention is identified generally by reference numeral 10 in FIG. 1 and is further illustrated in FIGS. 2 through 11. The archery training device 10 is used for teaching an archer 12 proper upper body muscular memory and positioning while shooting a bow 14 including a bowstring 16.

Figure 2:
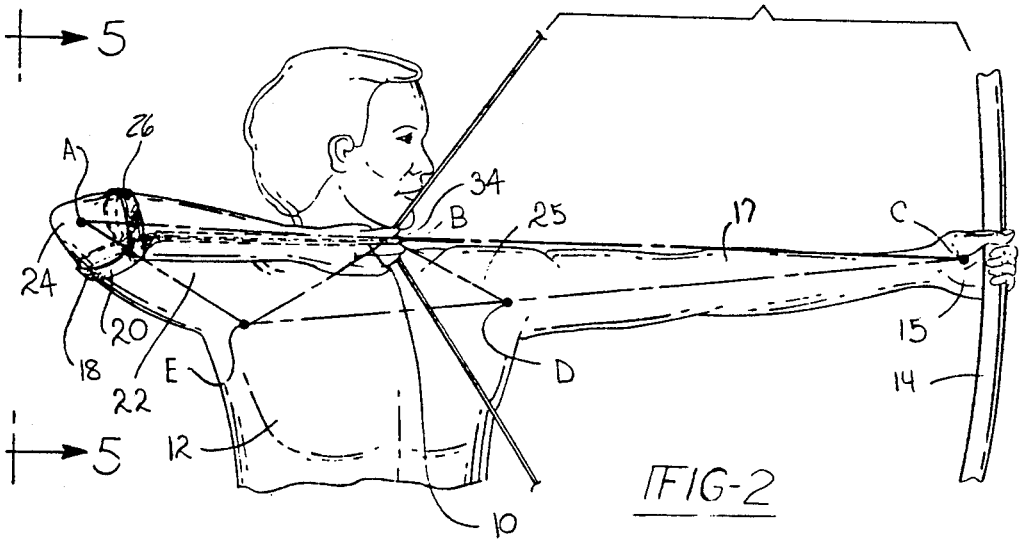
FIG. 2 is a side view of the archery training device of FIG. 1 used with an archery bow in a full draw configuration, the device being constructed in accordance with the present invention.
Figure 3:
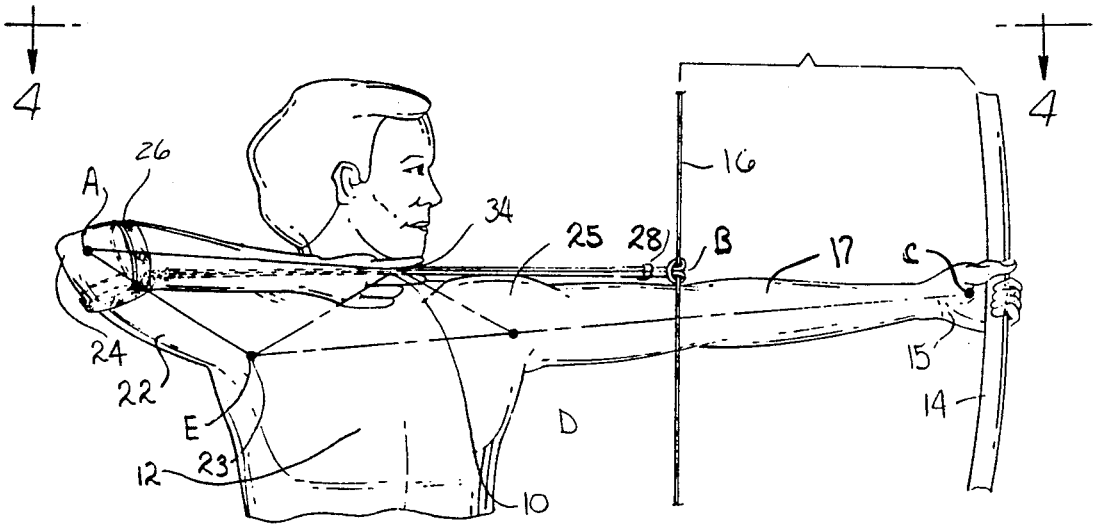
FIG. 3 is a side view of the archery training device constructed in accordance with the present invention, including a string arm connector and an elastomeric force carrying member, shown in a released configuration after bowstring release.
Figure 4:
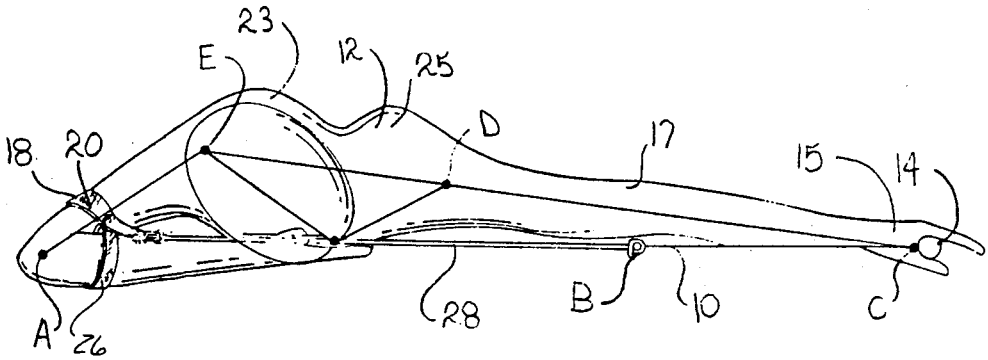
FIG. 4 is a top view of the archery training device in the released configuration after bowstring release taken along the line 4—4 of FIG. 3.
Figure 8:
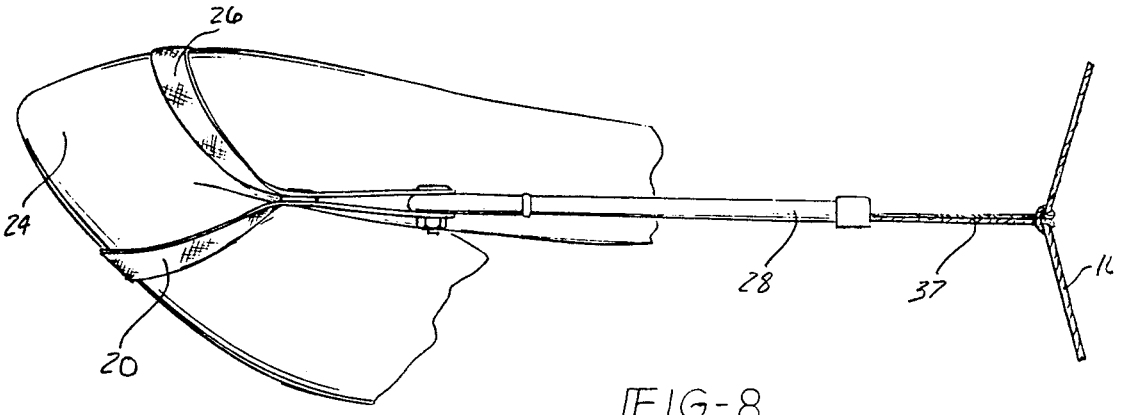
FIG. 8 is a cut-away side view of the archery device of FIG. 2 showing in fuller detail the arrangement of the archery device when worn by an archer.

As seen in FIGS. 2 through 4, the archery training device 10 includes a string arm connector 18 including an upper loop 20 which is securable to the upper arm of the archer's string arm 22 proximate his elbow 24. Also included in the string arm connector 18 is a lower loop 26 which is securable to the forearm of the archer's string arm 22 proximate his elbow 24. As best seen in FIG. 8, the loops 20 and 26 together cooperate to straddle the elbow 24 to prevent shifting thereof about the elbow 24, thereby avoiding unwanted shifting of the archery training device 10 and promoting operational safety.

An elastomeric force carrying member 28 is attached to the string arm connector 18 opposite the upper loop 20 and lower loop 26 and in use is secured to the bowstring 16. FIGS. 2 and 8 illustrate the bowstring 16 in a full draw position, wherein the elastomeric force carrying member 28 is in a relaxed configuration and the bowstring 16 is at its shortest distance from the archer's string arm elbow 24.

Upon release of the bowstring 16 by the hand fingers, as shown in FIG. 3, the elastomeric force carrying member 28 extends as the bowstring 16 travels toward the bow 14, resulting in the elastomeric force carrying member 28 being in a stretched configuration. The stretched configuration causes a pulling force upon the muscles associated with the upper back which position the archer's bow hand 15, string arm 22, and shoulders 23 and 25. These portions of the archer's anatomy are what must refrain from movement that would otherwise adversely affect shooting accuracy. It is the pulling force associated with the stretched configuration of the archery training device 10 which exercises these muscles to maintain a memory position so as to minimize movement during release of the bowstring 16 and thereby eliminate the adverse effects of the reflex muscle relax time.

Figure 5:
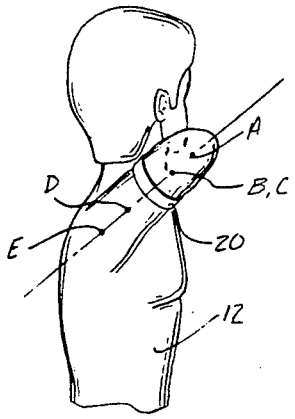
FIG. 5 is a rear view of an archer using the archery training device of the present invention taken along line 5—5 of FIG. 2, and showing a "rigid frame plane"

An understanding of the concept that resulted in the development of the archery training device 10 is facilitated by the collective views of FIGS. 2 through 5. In FIG. 5, for example, there is a rear view illustrating a "rigid frame plane" illustrating the coplanar relationship of points on the archer's string arm 22, string arm elbow 24, bow hand 15 and shoulders 23 and 25. In FIGS. 2 through 5, the following reference alphabetic terminology is used:

| Reference Letter | Denoting |
|---|---|
| A | String arm elbow 24 |
| B | Anchor or arrow nocking point 34 of bowstring by string fingers |
| C | Contact point 15 of bow by bow hand |
| D | Front shoulder joint 25 |
| E | Rear shoulder joint 23 |

With primary reference to FIG. 5, the "rigid frame plane" concept involves aligning points A through E of the archer's upper body in a single plane. For best accuracy and consistency in shooting, it has been discovered that the anchor point ("B"), the rear elbow joint ("A"), the contact ("C") of the bow hand 15 to bow handle, and the front and rear shoulder joints ("D" and "E") should be coplanar on the rigid frame plane in the full draw position. When points A through E are positioned so that they are coplanar, forces created by the bowstring being drawn do not move the bow hand or string hand as much from the intended trajectory of the arrow during the reflex muscle relax time.

If not aligned in a coplanar relationship before release of the bowstring 16, the bow hand 15, the string arm 22 and hand fingers have a tendency to move during the reflex muscle relax time, thus causing the archer's aim to move further away from the intended trajectory and adversely affecting shooting accuracy. Even a small amount of movement caused by a resultant force due to the string elbow being below the rigid frame plane will tend to move the string hand and hand fingers away from the archer's neck during the reflex muscle relax time, thus causing inaccuracy in shooting.

Figure 9:
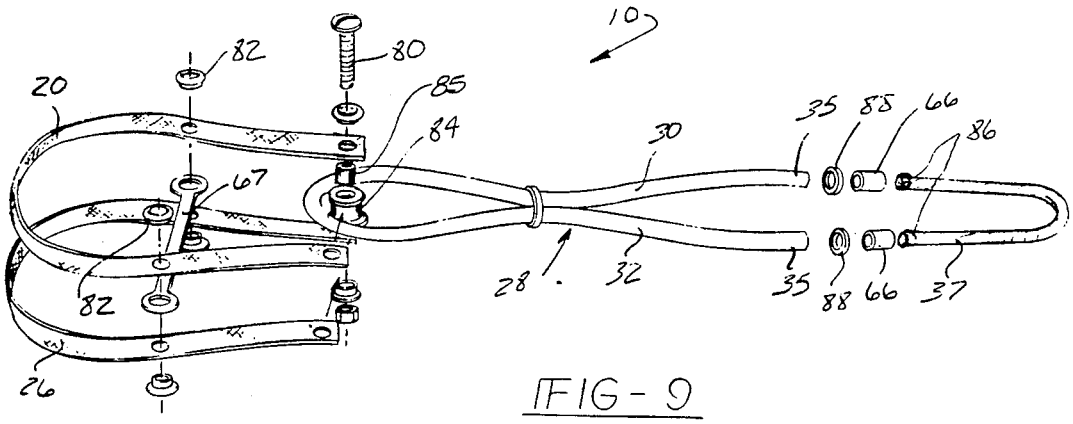
FIG. 9 is an exploded view of the archery device showing the preferred construction in accordance with a preferred embodiment of this invention.
Figure 10:
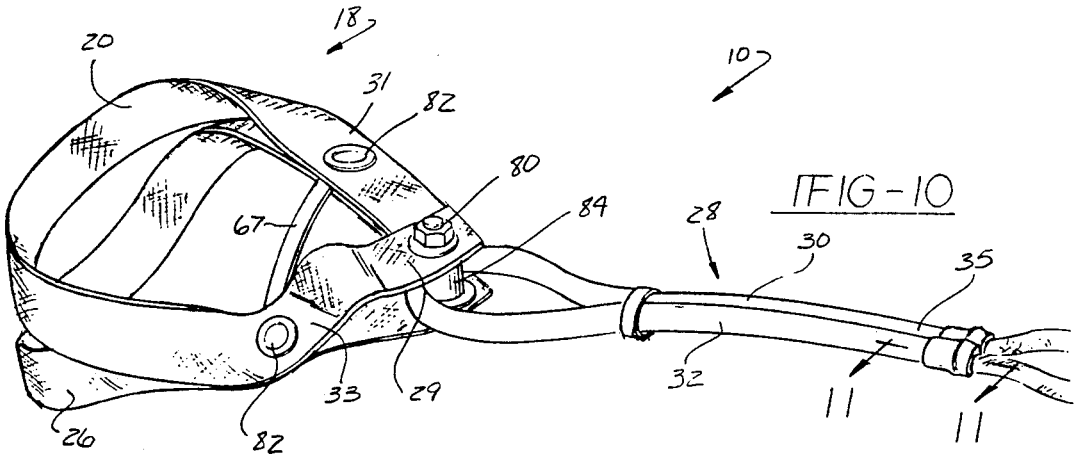
FIG. 10 is a perspective view of the archery training device in accordance with the preferred embodiment of this invention.
Figure 6:
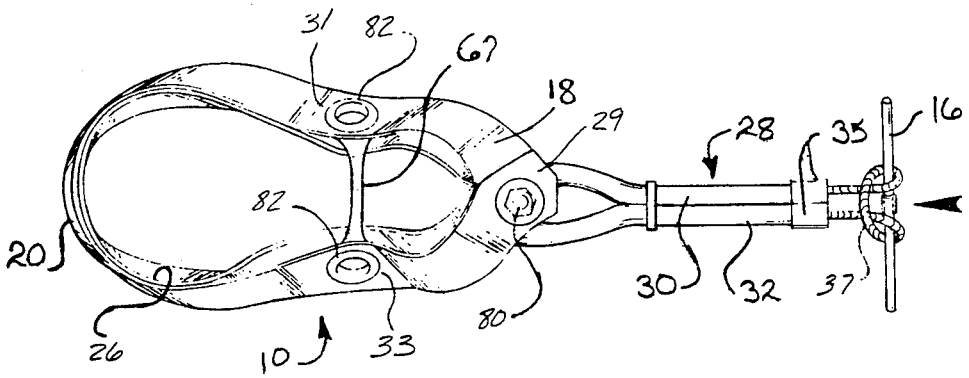
FIG. 6 is a side view of the archery training device showing the method used to secure the archery training device to the bowstring of the archery bow.

In a preferred embodiment, there is shown in FIGS. 6, 9 and 10 the archery training device 10 in accordance with the present invention. The preferred archery training device 10 has a string arm connector 18 and an elastomeric force carrying member 28 attached thereto. In addition, the elastomeric force carrying member 28 has a rope portion 37 extending opposite the string arm connector 18 for attaching the elastomeric force carrying member 28 to the bowstring 16 of the bow (not shown).

The string arm connector 18 includes the upper loop 20 which is securable to the upper arm of the archer's string arm and the lower loop 26 which is securable to the forearm of the archer's string arm 22. Both the upper and lower loops 20 and 26 are intended to be positioned on the string arm adjacent the elbow, as seen in FIGS. 1, 5 and 8, and act to prevent shifting of the string arm connector 18 on the archer's string arm 22.

Referring to FIGS. 6, 9 and 10, the upper loop 20 and the lower loop 26 are fastened together at a first anchor point 29. The fastening method used can be any conventional form which is strong but yet lightweight and suitable for mass production, preferably a threaded fastener 80 as shown in FIG. 9. The upper and lower loops 20 and 26 are also fastened together at a second anchor point 31 and a third anchor point 33. The second and third anchor points 31 and 33 can be provided adequately using grommets 82, as best shown in FIG. 9. Preferably the second and third anchor points 31 and 33 are located equidistant from, but on opposite sides of, the first anchor point 29. An intermediate elastomeric member 67 extends between the second and third anchor points 31 and 33 so as to reduce the effective size of the upper and lower loops 20 and 26 and to pull the upper and lower loops 20 and 26 toward each other when on the string arm 22. By this construction, the upper and lower loops 20 and 26 can better conform to the archer's upper arm and forearm, thereby further minimizing the likelihood of the string arm connector 18 slipping on the archer's string arm 22.

The elastomeric force carrying member 28 is provided as a pair of resilient coacting members 30 and 32. The coacting members 30 and 32 are preferably formed as a unitary piece which is attached at its midsection to the first anchor point 29. To promote the life of the elastomeric force carrying member 28, a Teflon® pulley 84 and supporting bushing is provided at the first anchor point 29 around which the midsection of the elastomeric force carrying member is wrapped. The coacting members 30 and 32 extend side by side from the first anchor point 29, terminating at complementary distal ends 35.

Figure 11:
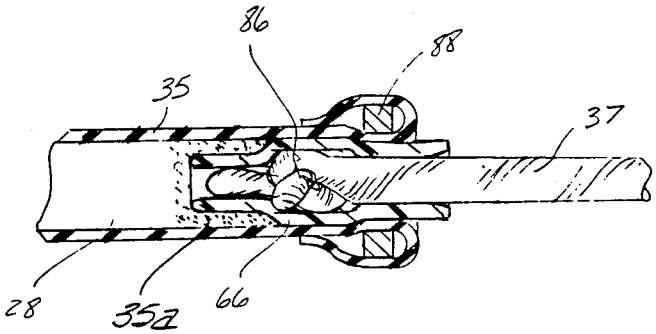
FIG. 11 is a sectional view of a portion of the preferred embodiment of the archery training device taken along line 11—11 of FIG. 10.
Figure 7:
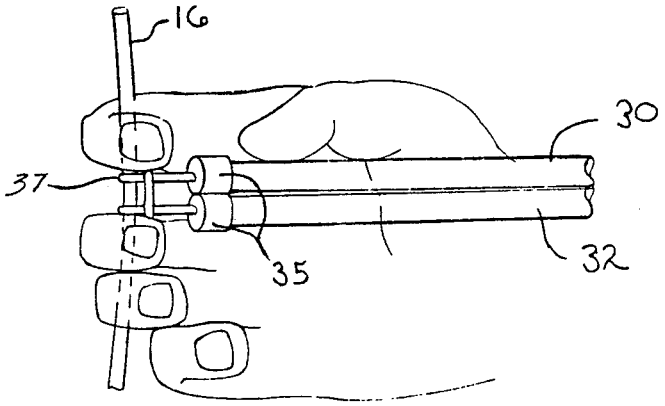
FIG. 7 is a cut-away detailed view of the archery training device showing the archery training device secured to the bowstring in a full draw configuration.

The rope portion 37 is securely attached to the coacting members 30 and 32 at their distal ends 35. As seen in FIG. 11, the rope portion 37 is preferably secured to the distal ends 35 by means of stops such as knots 86 provided at each end of the rope portion 37 in cooperation with clasps 88 which are attached at the distal ends 35 of the elastomeric force carrying member 28. The interference created between the stops 86 and their respective clasps 88 secures the elastomeric force carrying member 28 and the rope portion 37 together, and the rope portion 37 thereby extends between the distal ends 35 of the coacting members 30 and 32. To reduce any abrasive action between the elastomeric force carrying member 28 and the stops 86, as well as the end of the rope portion 37, a shrink sleeve 66 is positioned between the rope portion 37 and each distal end 35 of the elastomeric force carrying member 28. It has also been found beneficial to lubricate the inside of the elastomeric force carrying member 28 near the distal ends 35 with any convenient lubricant as shown at 35*a*. Once assembled, the distal ends 35 can be inverted and rolled back to protect the archer 12 from the clasps 88. The cross-sectional diameter of the rope portion 37 may be any convenient size, keeping in mind that the diameter must be selected so as to be readily securable to the bowstring, in the same manner as shown in FIGS. 6 and 7, while also being sufficiently large to provide adequate strength.

The purpose and advantage in employing the rope portion 37 is that the elastomeric force carrying member 28 itself is not secured to the bowstring. Accordingly, longer life of the elastomeric force carrying member 28 is promoted. The rope portion 37 is also more easily attached to the bowstring than would be the elastomeric force carrying member 28. Consequently, good results can be achieved when the elastomeric force carrying member 28 is made of latex tubing.

By repeated use of the archery training device 10, the archer is aided in developing a perfect shot. This is characterized by coplanar movement of the points A through E (FIG. 5) from the beginning of bowstring release to the completion of the shot. Thus, repeated practice with the archery training device 10 teaches the archer proper upper body rear muscular control, body positioning and push-pull balance for accurate shooting in a manner that was not heretofore possible.

In operation, the archer 12 draws the bow 14 to the full draw position (FIG. 2) without an arrow, placing the elastomeric force carrying member 28 in its relaxed configuration. When the archer 12 has correctly aimed, he releases the bowstring 16. During the release, the elastomeric force carrying member 28 is stretched from the full draw position (FIG. 2) to the released position (FIGS. 3 and 4). This stretching produces a force that is transferred to the string arm 22, the bow arm 17, and the remaining parts of the entire upper body framework. Forces exerted on the upper body by the elastomeric force carrying member 28 in transitioning between the full draw position and the released position require the archer 12 to push and pull his upper body muscles so that they work throughout the duration of the shot. This minimizes the reflex muscle relax time as defined earlier, and improves both the accuracy and consistency of shooting with repeated practice.

Figure 12:
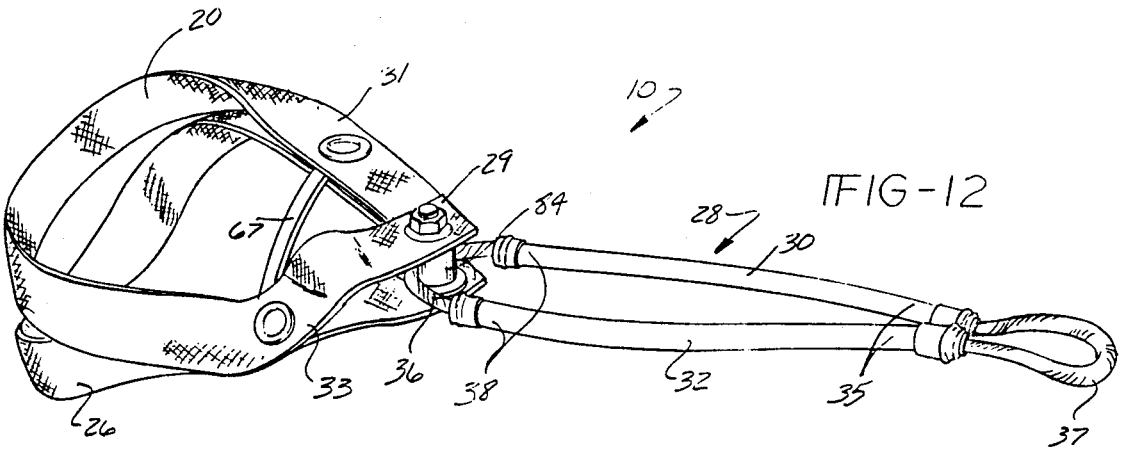
FIG. 12 is a side view of another embodiment of the archery training device of the present invention.

Turning now to FIG. 12, there is depicted another embodiment of the archery training device 10 which uses an elastomeric force carrying member 28 formed as a two-piece construction. Each resilient member 30 and 32 has a proximate end 38 opposite its distal end 35. In a similar fashion as described for the distal ends 35 of the preferred embodiment, a second rope portion 36 is secured to both proximate ends 38 in the same manner illustrated in FIG. 11. Positioned between the proximate ends 38 of the elastomeric force carrying member 28, the second rope portion 36 further protects the elastomeric force carrying member 28 from the Teflon® bushing 84.

While the best modes for carrying out the invention have been described in detail, those familiar with the art to which this invention relates will recognize various alternative designs and embodiments for carrying out the invention as defined by the following claims.

What is claimed is:

1. An archery training device for promoting a coplanar interrelationship between an archer's shoulders, bow hand, string hand, string arm and string arm elbow when drawing and releasing a bowstring of a bow, said archery training device being worn on said string arm which said archer uses to draw said bowstring, said archery training device comprising:

a string arm connector, said string arm connector having an upper securing means and a lower securing means, said upper securing means being securable to an upper arm portion of said string arm, said lower securing means being securable to a forearm portion of said string arm, said upper securing means and said lower securing means cooperating together to prevent shifting of said string arm connector upon said string arm; and an elastomeric member having one end attached to said string arm connector and an opposite end attached to said bowstring, said elastomeric member being elastically extended between said string arm connector and said bowstring upon release of said bowstring by said string hand so as to create a tensional force therebetween, said tensional force forcing muscles of said shoulders and string arm to remain taut to prevent collapse of said string arm toward said bowstring upon release of said bowstring, said collapse otherwise adversely affecting said archer's ability to accurately aim said bow, said tensional force further providing feedback of proper position and push-pull balance after release of said bowstring.

2. The archery training device of claim 1 wherein said upper securing means is an upper loop in said string arm connector and said lower securing means is a lower loop in said string arm connector.

3. The archery training device of claim 1 wherein said upper securing means and said lower securing means are both secured adjacent said string arm elbow of said string arm.

4. The archery training device of claim 1, further comprising a rope portion attached to said elastomeric member, said rope portion being adapted for securing said elastomeric member to said bowstring.

5. An archery training device for promoting a coplanar interrelationship between an archer'shoulders, bow hand, string hand, string arm and string arm elbow when drawing and releasing a bowstring of a bow, said archery training device being worn on said string arm which said archer uses to draw said bowstring, said archery training device comprising:

a string arm connector, said string arm connector having an upper loop and a lower loop, said upper loop being securable to an upper arm portion of said string arm, and said lower loop being securable to a forearm portion of said string arm, said upper loop and said lower loop cooperating together to prevent shifting of said string arm connector upon said string arm; and an elastomeric member attached to said string arm connector, said elastomeric member being securable to said bowstring, said elastomeric member being thereby elastically extended between said string arm connector and said bowstring upon release of said bowstring by said string hand so as to create a tensional force therebetween, said tensional force forcing muscles of said shoulders and said string arm to remain taut to prevent collapse of said string arm toward said bowstring, said collapse otherwise adversely affecting said archer's ability to accurately aim said bow;

whereby said archery training device provides positional feedback to said archer via said tensional force, said tensional force increasing said positional feedback as said archer's shoulders, bow hand, string hand, string arm and string arm elbow deviate from said coplanar interrelationship, said positional feedback facilitating said archer's ability to accurately aim said bow.

6. The archery training device of claim 5 wherein said upper loop and said lower loop are both secured adjacent said string arm elbow of said string arm.

7. The archery training device of claim 5, further comprising a rope portion attached to said elastomeric member, said rope portion being adapted for securing said elastomeric member to said bowstring.

8. The archery training device of claim 5 further comprising a first anchor point located on said string arm connector, said upper loop and said lower loop being joined together at said first anchor point, said elastomeric member being attached to said string arm connector at said first anchor point.

9. The archery training device of claim 8 further comprising a second anchor point and a third anchor point, located on said string arm connector, said upper loop and said lower loop being further joined together at both said second anchor point and said third anchor point, said second anchor point and said third anchor point being approximately equidistantly spaced from said first anchor point.

10. The archery training device of claim 9, further comprising an intermediate elastomeric member, said intermediate elastomeric member extending between said second anchor point and said third anchor point so as to further secure said string arm connector to said string arm.

11. The archery training device of claim 5 wherein said elastomeric member comprises two coacting portions, said two coacting portions each having a distal end in relation to said string arm connector, each said distal end being securable to said bowstring.

12. The archery training device of claim 11, further comprising a rope portion attached to and extended between said distal ends, said rope portion being adapted for securing said elastomeric member to said bowstring.

13. The archery training device of claim 11, wherein said two coacting portions each have a proximate end in relation to said string arm connector, and wherein said archery training device further comprises a second rope portion attached to and extended between said proximate ends, said second rope portion being adapted for securing said elastomeric member to said first anchor point.

* * * * *

UNITED STATES PATENT AND TRADEMARK OFFICE

CERTIFICATE OF CORRECTION

PATENT NO. : 5,163,413

DATED : November 17, 1992

INVENTOR(S) : Richard F. Carella

It is certified that error appears in the above-identified patent and that said Letters Patent is hereby corrected as shown below:

On the Title page, item [57],
In the Abstract, line 3, delete "whiel" and insert ---- while ----.

Signed and Sealed this

Seventh Day of June, 1994

Attest:

Bruce Lehman

BRUCE LEHMAN

Attesting Officer

Commissioner of Patents and Trademarks